US005278617A

United States Patent [19]

Boisvert et al.

[11] Patent Number: 5,278,617

[45] Date of Patent: Jan. 11, 1994

[54] MODIFIED DONOR ROLL

[75] Inventors: Martial J. Boisvert, Bois Des Filion, Canada; Edward T. Hinton, Rochester, N.Y.

[73] Assignee: Xerox Corporation, Stamford, Conn.

[21] Appl. No.: 985,771

[22] Filed: Dec. 4, 1992

[51] Int. Cl.[5] ..... G03G 15/20

[52] U.S. Cl. ..... 355/284; 355/285; 219/216; 432/60; 118/258

[58] Field of Search ..... 355/284, 285, 289, 290; 118/204, 212, 244, 258, 264, 268; 219/216, 388; 432/60, 228

[56] References Cited

U.S. PATENT DOCUMENTS

| | | | |
|---|---|---|---|
| 3,841,827 | 10/1974 | Thettu | 432/60 |
| 3,844,252 | 10/1974 | Thettu | 118/60 |
| 3,881,859 | 5/1975 | Hamilton | 432/60 |
| 4,052,150 | 10/1977 | Behun | 432/60 |
| 4,258,648 | 3/1981 | Leising et al. | 118/60 |
| 4,336,766 | 6/1982 | Maher et al. | 118/60 |
| 4,426,953 | 1/1984 | Kromm, Jr. et al. | 118/60 |
| 4,488,504 | 12/1984 | Vineski | 118/60 |
| 4,908,670 | 3/1990 | Ndebi | 355/284 |
| 5,043,768 | 8/1991 | Baruch | 355/284 |
| 5,045,889 | 9/1991 | Hoover | 355/284 |
| 5,145,525 | 9/1992 | Fromm et al. | 118/264 X |
| 5,232,499 | 8/1993 | Kato et al. | 118/244 |
| 5,235,394 | 8/1993 | Mills et al. | 355/284 |

FOREIGN PATENT DOCUMENTS

| | | | |
|---|---|---|---|
| 60-151680 | 8/1985 | Japan | 355/284 |
| 60-172063 | 9/1985 | Japan | 355/284 |
| 61-148479 | 7/1986 | Japan | 355/284 |
| 63-172186 | 7/1988 | Japan | 355/284 |
| 3-282577 | 12/1991 | Japan | 355/284 |
| 2031342 | 4/1980 | United Kingdom | 355/284 |

*Primary Examiner*—R. L. Moses
*Attorney, Agent, or Firm*—Kevin R. Kepner

[57] ABSTRACT

A release agent management system incorporated in an electrophotograpic printing machine having a heat and pressure fuser assembly with stripper fingers to aid in the removal of fused copies from the fuser roll. The fuser assembly includes a heated fuser roll, a pressure roll, a sump containing a quantity of release agent, a metering roll and a donor roll. The metering roll is immersed in a quantity of release agent and is in contact with the donor roll. The donor roll acts as the transport to transfer release agent from the metering roll to the heated fuser roll. The surface of the donor roll is provided with cutout grooved areas corresponding to the location of the stripper fingers on the fuser roll. These grooves result in a lesser amount of release agent being applied to the fuser roll in the area adjacent the stripper fingers. This lesser amount of release agent applied in the stripper finger area minimizes release agent buildup under the stripper fingers and the subsequent copy degradation due to transfer of release agent to the copies.

12 Claims, 3 Drawing Sheets

MODIFIED DONOR ROLL

This invention relates generally to a fuser release agent distribution system for an electrophotographic printing machine, and more particularly concerns a modified donor roll to prevent release agent build-up on electrophotographic copies.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an adhesive material, such as a silicone rubber or other low surface energy elastomer or, for example, tetrafluoroethylene resin sold by E. I. DuPont De Nemours under the trademark Teflon. In these fusing systems, however, since the toner image is tackified by heat, it frequently happens that a part of the image carried on the supporting substrate will be retained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate.

To obviate the foregoing toner offset problem, it has been common practice to utilize toner release agents such as silicone oil, in particular, polydimethyl silicone oil, which is applied to the fuser roll surface to a thickness of the order of about 1 micron to act as a toner release material. These materials possess a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface. Apparatus for applying the release agent material to a fuser member is commonly referred to as a release agent management (RAM) system.

In printing machines which utilize stripper fingers to assist in the removal of the fixed toner image copy sheet from the fuser roll, there is often a buildup of release agent at the location of the stripper fingers. This buildup can cause a transfer of the release agent to the copy sheets thereby creating defective copies. It is, therefore, desirable to apply less release agent in the area on the fuser corresponding to the stripper finger while still applying enough release agent to prevent toner offset.

The following disclosures may be relevant to various aspects of the present invention:

U.S. Pat. No. 4,488,504
Patentee: Vineski
Issue Date: Dec. 18, 1984

U.S. Pat. No. 4,426,953
Patentee: Cromm, et ano
Issue Date: Jan. 24, 1984

U.S. Pat. No. 4,336,766
Patentee: Maher, et ano
Issue Date: Jun. 29, 1982

U.S. Pat. No. 4,258,648
Patentee: Leising, et ano
Issue Date: Mar. 31, 1981

U.S. Pat. No. 3,881,859
Patentee: Hamilton
Issue Date: May 6, 1975

U.S. Pat. No. 3,844,252
Patentee: Thettu
Issue Date: Oct. 29, 1974

U.S. Pat. No. 4,052,150
Patentee: Behun
Issue Date: Oct. 4, 1977

The relevant portions of the foregoing disclosures may be briefly summarized as follows:

U.S. Pat. No. 4,488,504 discloses a fuser apparatus in which a release agent management system delivers an excess quantity of silicone oil to the roll surface to flush the surface of paper fibers and other contaminants.

U.S. Pat. No. 4,426,953 describes a fusing apparatus utilizing a donor roll, metering roll and a metering blade which cooperate to convey silicone oil from the sump to the surface of a heated fuser roll. The metering roll which is contacted by the metering blade is provided with a helical grove which acts to scrape the tip of the metering blade as the roll rotates and moves paper related residue to the end of the metering roll where it is collected for disposal.

U.S. Pat. No. 4,336,766 describes a roll fuser apparatus and release agent management system which utilizes a dispenser to dispense silicone oil onto the surface of the fuser roll strategically located such that the oil is introduced in the areas of sheet edge contact to minimize damage to the fuser roll.

U.S. Pat. No. 4,258,648 discloses a heat and pressure roll fusing apparatus, a fluid metering system provided with a tapered roll that is adapted to apply release fluid to the entire outer fuser roll surface or to only a portion thereof in the center of the fuser roll depending on the substrate size being utilized.

U.S. Pat. No. 3,881,859 discloses a fuser apparatus utilizing stripper fingers containing oil absorbent material disposed between portions of the stripper finger for removing excess release agent material from the leading edges of the stripper finger elements.

U.S. Pat. No. 4,052,150 discloses a stripping apparatus for a fuser including a finger having a comb-like arrangement of channels on the front surface of the stripper finger and having a notch extending transversely to the stripping direction to interconnect the channels to remove excess oil therefrom.

U.S. Pat. No. 3,844,252 discloses a fuser device having a stripper finger in which a portion of the stripper finger is configured so as to absorb excess fuser release agent to prevent copy degradation and harming of the fuser roll during sheet separating operation.

In accordance with one aspect of the present invention, there is provided An apparatus in which an offset preventing liquid is applied to a fuser member defining a nip with a pressure member through which a sheet having an image thereon passes to fuse the image to the sheet, wherein the improvement comprises a donor member having a portion of the surface thereof in contact with the surface of said fuser member, said donor member having another portion of the surface thereof spaced from the surface of said donor member. Means for applying the offset preventing liquid to the portion of the surface of said donor member in contact with said fuser member with the portion spaced from said fuser member being substantially devoid of the offset preventing liquid liquid is also provided.

Pursuant to another aspect of the present invention, there is provided an electrophotographic printing machine in which an offset preventing liquid is applied to a fuser member defining a nip with a pressure member through which a sheet having an image thereon passes to fuse the image to the sheet, wherein the improvement comprises a donor member having a portion of the surface thereof in contact with the surface of said fuser member, said donor member having another portion of the surface thereof spaced from the surface of said donor member. Means for applying the offset preventing liquid to the portion of the surface of said donor member in contact with said fuser member with the portion spaced from said fuser member being substantially devoid of the offset preventing liquid is also provided.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 4:
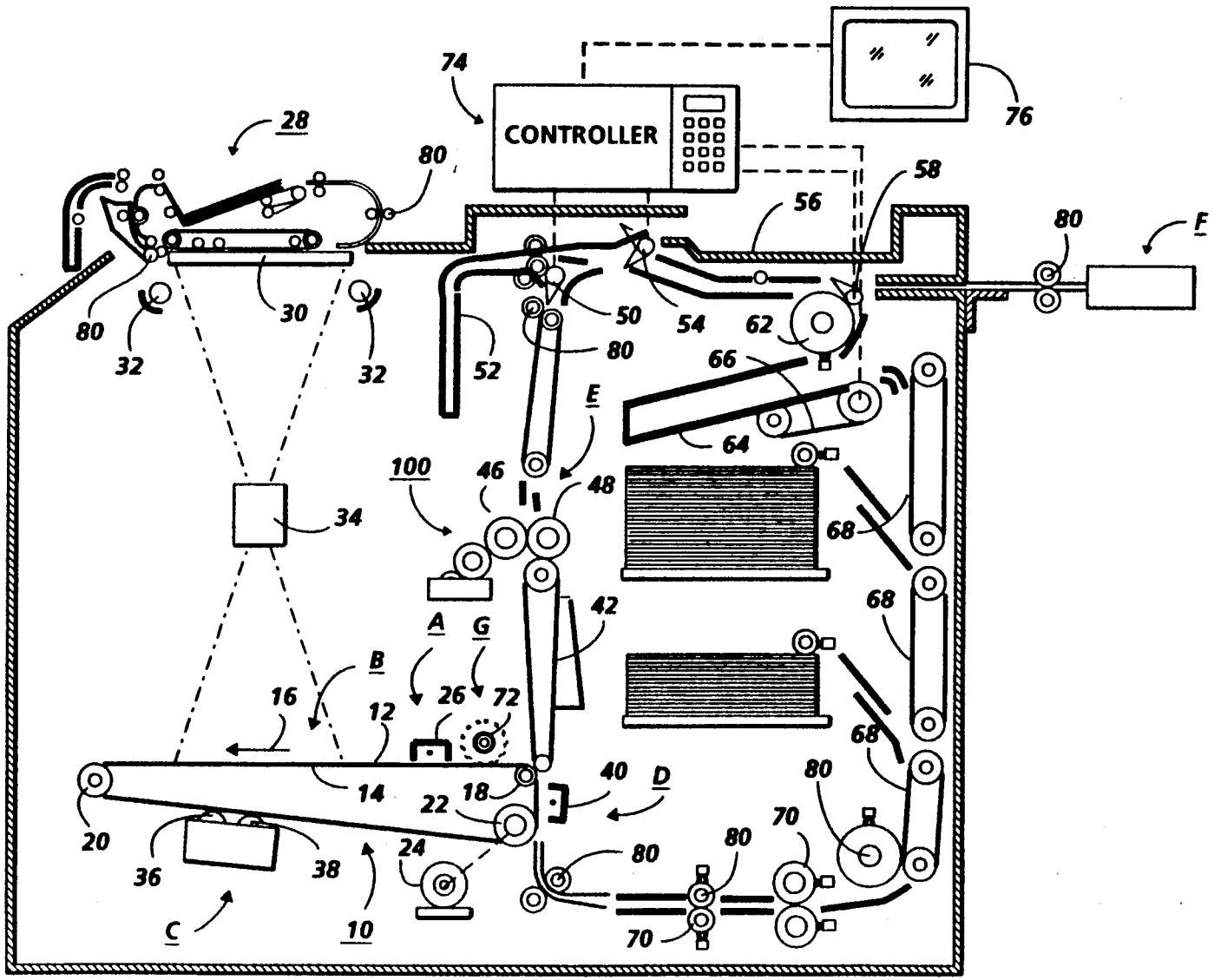
FIG. 4 is a schematic view of an electrophotographic printing machine incorporating the fuser assembly of FIG. 1.

For general understanding of the features of the present invention, reference is made to the drawings. In the drawings, like reference numerals have been used throughout to identify identical elements. FIG. 4 schematically depicts an electrophotographic printing machine incorporating the features of the present invention therein. It will become evident from the following discussion that the sheet feeding apparatus of the present invention may be employed in a wide variety of devices and is not specifically limited in its application to the particular embodiment depicted herein.

Referring to FIG. 4 of the drawings, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Other suitable photoconductive materials and conductive substrates may also be employed. Belt 10 moves in the direction of arrow 16 to advance successive portions of photoconductive surface 12 sequentially through the various processing stations disposed about the path of movement thereof. Belt 10 is entrained about stripping roller 18, tensioning roller 20, and drive roller 22. Stripping roller 18 is mounted rotatably so as to rotate with belt 10. Tensioning roller 20 is resiliently urged against belt 10 to maintain belt 10 under the desired tension. Drive roller 22 is rotated by motor 24 coupled thereto by suitable means such as a belt drive. As roller 22 rotates, it advances belt 10 in the direction of arrow 16.

Initially, a portion of photoconductive surface 12 passes through charging station A. At charging station A, a corona generating device, indicated generally by the reference numeral 26, charges photoconductive surface 12 to a relatively high, substantially uniform potential.

Next, the charged portion of photoconductive surface 12 is advanced through imaging station B. At imaging station B, a document handling unit, indicated generally by the reference numeral 28, is positioned over platen 30 of the printing machine. Document handling unit 28 sequentially feed documents from a stack of documents placed by the operator faceup in a normal forward collated order in the document stacking and holding tray. A document feeder located below the tray forwards the bottom document in the stack to a pair of take-away rollers. The bottom sheet is then fed by the rollers to a feed roll pair and belt. The belt advances the document to platen 30. After imaging, the original document is fed from platen 30 by the belt into a guide and feed roll pair. The document then advances into an inverter mechanism and back to the document stack through the feed roll pair. A position gate is provided to divert the document to the inverter or to the feed roll pair. Imaging of a document is achieved by lamps 32 which illuminate the document on platen 30. Light rays reflected from the document are transmitted through lens 34. Lens 34 focuses light images of the original document onto the charged portion of photoconductive surface 12 of belt 10 to selectively dissipate the charge thereon. This records an electrostatic latent image on photoconductive surface 12 which corresponds to the informational area contained within the original document. Obviously, electronic imaging of page image information could be facilitated by a printing apparatus utilizing electrical imaging signals. The printing apparatus can be a digital copier including an input device such as a raster input scanner (RIS) and a printer output device such as a raster output scanner (ROS), or, a printer utilizing a printer output device such as a ROS.

Thereafter, belt 10 advances the electrostatic latent image recorded on photoconductive surface 12 to development station C. At development station C, a pair of magnetic brush developer rolls indicated generally by the reference numerals 36 and 38, advance developer material into contact with the electrostatic latent image. The latent image attracts toner particles from the carrier granules of the developer material to form a toner powder image on photoconductive surface 12 of belt 10. Belt 10 then advances the toner powder image to transfer station D.

Prior to reaching transfer station D, a copy sheet is placed in proper lateral edge alignment. At transfer station D, a copy sheet is moved into contact with the toner powder image. Transfer station D includes a corona generating device 40 which sprays ions onto the backside of the copy sheet. This attracts the toner powder image from photoconductive surface 12. After transfer, conveyor 42 advances the copy sheet to fusing station E.

Fusing station E includes a fuser assembly, indicated generally by the reference numeral 100, which permanently affixes the transferred toner powder image to the copy sheet. Preferably, fuser assembly 100 includes a heated fuser roller 46 and a back-up roller 48 with the powder image on the copy sheet contacting fuser roller 46. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll incorporating the invention herein and then to the fuser roll. The fused copy sheets are removed from the fuser roll 46 by stripper fingers 110. A detailed description of the invention herein is set forth below with reference to FIGS. 1-3.

After fusing, the copy sheets are fed to gate 50 which functions, as an inverter selector. Depending upon the position of gate 50, the copy sheets are deflected to sheet inverter 52 or bypass inverter 52 and are fed directly to a second decision gate 54. At gate 54, the sheet is in a faceup orientation with the image side, which has been fused, faceup. If inverter path 52 is selected, the opposite is true, i.e. the last printed side is facedown. Decision gate 54 either deflects the sheet directly onto an output tray 56 or deflects the sheet to decision gate 58. Decision gate 58 may divert successive copy sheets to duplex inverter roll 62, or onto a transport path to finishing station F. At finishing station F, copy sheets are stacked in a compiler tray and attached to one another to form sets. The sheets are attached to one another by either a binding device or a stapling device. In either case, a plurality of sets of documents are formed in finishing station F. When decision gate 58 diverts the sheet onto inverter roll 62, roll 62 inverts and stacks the sheets to be duplexed in duplex tray 64. Duplex tray 64 provides an intermediate or buffer storage for those sheets that have been printed on one side and on which an image will be subsequently printed on the second, opposed side thereof, i.e. the sheets being duplexed. The sheets are stacked in duplex tray facedown on top of one another in the order in which they are copied.

In order to complete duplex copying, the simplex sheets in tray 64 are fed, in seriatim, by bottom feeder 66 from tray 64 back to transfer station D via conveyors 68 and rollers 70 for transfer of the toner powder image to the opposed sides of the copy sheets. Inasmuch as successive bottom sheets are fed from duplex tray 64, the proper or clean side of the copy sheet is positioned in contact with belt 10 at transfer station D so that the toner powder image is transferred thereto. The duplex sheet is then fed through the same path as the simplex sheet to be stacked in tray 56 or, when the finishing operation is selected, to be advanced to finishing station F.

Invariably, after the copy sheet is separated from photoconductive surface 12 of belt 10, some residual particles remain adhering thereto. These residual particles are removed from photoconductive surface 12 at cleaning station G. Cleaning station G includes a rotatably mounted fibrous or electrostatic brush 72 in contact with photoconductive surface 12 of belt 10. The particles are cleaned from photoconductive surface 12 of belt 10 by the rotation of brush 72 in contact therewith. Subsequent to cleaning, a discharge lamp (not shown) floods photoconductive surface 12 to dissipate any residual electrostatic charge remaining thereon prior to the charging thereof for the next successive imaging cycle.

The various machine functions are regulated by a controller 74. Controller 74 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. The paper path signature analysis apparatus of the present invention can be utilized to keep track of the position of the documents and the copy sheets. In addition, controller 74 regulates the various positions of the decision gates depending upon the mode of operation selected. Thus, when the operator selects the finishing mode, either an adhesive binding apparatus and/or a stapling apparatus will be energized and the decision gates will be oriented so as to advance either the simplex or duplex copy sheets to the compiler tray at finishing station F.

Figure 3:
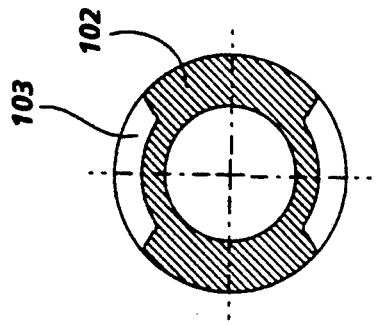
FIG. 3 is a sectional view of the donor roll of FIG. 2 taken in the direction of the arrows A—A of FIG. 2.

It is believed that the foregoing description is sufficient for purposes of the present application to illustrate the general operation of an electrophotographic printing machine. Referring now to the specific subject matter of the present invention, FIGS. 1 through 3 depict the release agent management system of the present invention.

Figure 1:
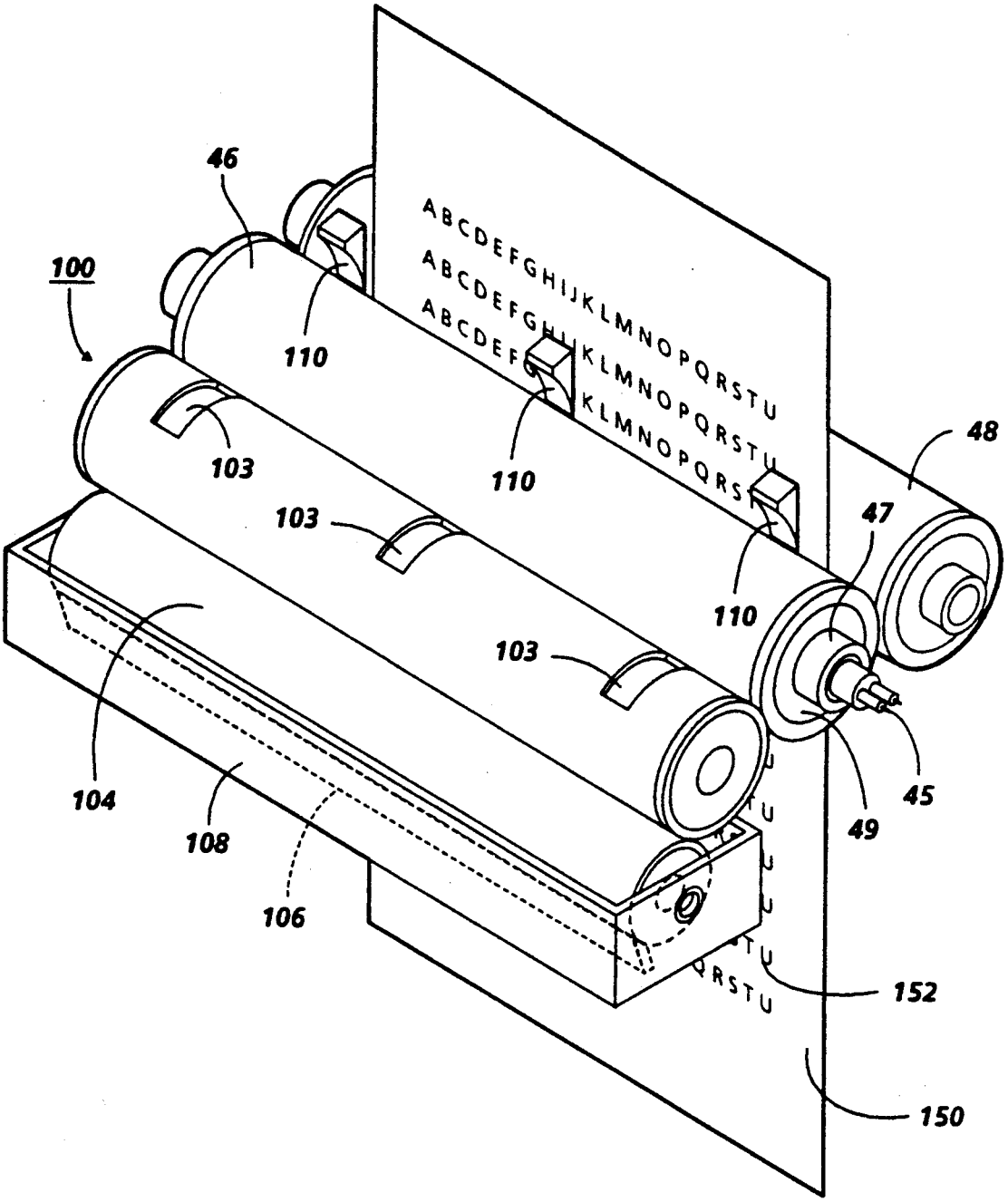
FIG. 1 is a perspective view of the fuser assembly utilizing the modified donor roll of the invention herein.
Figure 2:
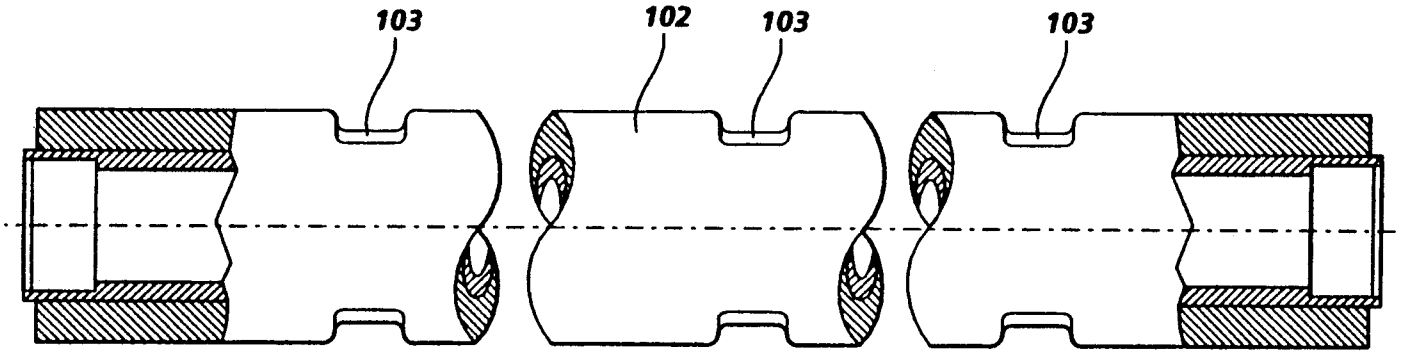
FIG. 2 is an elevational view, partially in section, of the modified donor roll of FIG. 1.

Turning now to FIG. 1, a heat and pressure fuser apparatus 100 comprising heated fuser roll structure 46 and a pressure roll structure 48 are illustrated together with a release agent management (RAM) system. As shown in FIG. 1, the heated fuser roll structure 46 comprises a core 47 having thereon a layer 49 or layers of a suitable elastomer. The core 47 may be made of various metals such as iron, aluminum, nickel, stainless steel, etc., and various synthetic resins. Aluminum is preferred as the material for the core 47, although this is not critical. The core 47 is hollow and a heating element 45 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention and the fuser member can be heated by internal means, external means or a combination of both. Heating means are well known in the art for providing sufficient heat to fuse the toner to the support. The fusing elastomer layer may be made of any of the well known materials such as the Viton TM (trademark of E. I. duPont de Nemours & Co.) Teflon TM (trademark of E. I. duPont de Nemours & Co.) and/or silicone rubber.

The heated fuser roll structure 46 is shown in a pressure contact arrangement with the backup or pressure roll 48. The pressure roll 48 comprises a metal core (not shown) with an outer layer (not shown) of a heat-resistant material. In this assembly, both the fuser roll 46 and the pressure roll 48 are mounted on bearings (not shown) which are biased so that the fuser roll structure 46 and pressure roll structure 48 are pressed against each other under sufficient pressure to form a nip 140. It is in this nip 140 that the fusing or fixing action takes place. The layer may comprise any of the well known materials such as Teflon TM a trademark of E. I. duPont de Nemours & Co, Viton, silicone rubber or EPDM (ethylene-propylene diene monomer).

An image receiving member or final support 150 having toner images 152 thereon is moved through the nip 140 with the toner images contacting the heated fuser roll structure 46. The toner material forming the images 152 is prevented from offsetting to the surface of the fuser roll structure 46 through the application of a release agent material such as silicone oil contained in sump 108. As can be seen more clearly in FIGS. 2 and 3, there are grooves 103 in the donor roll 102 corresponding to the location of each of the stripper fingers 110. These grooves each span approximately ninety degrees of the circumference of the donor roll surface and are spaced approximately one hundred eighty degrees from leading edge to leading edge. As a result, in the area of the stripper fingers, which are aligned with the grooves 103, there is only one half the contact between the fuser roll and the donor roll. This lessor contact prevents release oil build-up on the stripper fingers which then can be transferred to the copy sheets causing defects in the finished copies. Of course, the portion of the circumference of the roll around which the grooves extend can be altered depending on the application.

The sump 108 and silicone oil form part of the RAM system. The RAM system comprises a metering roll structure 104 and a donor roll structure 102. The metering roll is supported so that it contacts a wick (not shown) impregnated with silicone oil and is positioned to contact the donor roll for conveying silicone oil from the sump to the surface of the donor roll 102. The metering roll 104 may also partially immersed in silicone oil. The donor roll 102 is rotatably supported in contact with the metering roll and also in contact with the fuser roll 46. While the donor roll 102 is illustrated as contacting the fuser roll, it will be appreciated that, alternately, it may contact the pressure roll 48. Also, the positions of the fuser and pressure rolls may be reversed and used in copiers or printers. A metering blade 106 supported in contact with the metering roll 104 serves to meter silicone oil to the required thickness on the metering roll.

In recapitulation, there is provided a pressure and heat toner fixing fuser having a release agent management system. A metering roll in contact with a supply of release agent such as silicone oil is in contact with a donor roll. The donor roll has a portion of its surface removed corresponding to the location of the fuser stripper fingers. As a result of the lessor surface contact area in the stripper finger areas, a buildup of release agent on the fuser in those areas is prevented. This minimizes the transfer of release agent to the copy sheet as a result of such buildup.

It is, therefore, apparent that there has been provided in accordance with the present invention, a fuser release agent distribution system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus in which an offset preventing liquid is applied to a fuser member defining a nip with a pressure member through which a sheet having an image thereon passes to fuse the image to the sheet, wherein the improvement comprises:

a donor member having a portion of the surface thereof in contact with the surface of said fuser member, said donor member having another portion of the surface thereof spaced from the surface of said donor member; and means for applying the offset preventing liquid to the portion of the surface of said donor member in contact with said said fuser member with the portion spaced from said fuser member being substantially devoid of the offset preventing liquid.

2. An apparatus according to claim 1, further comprising means for stripping the sheet from said fuser member with the portion of the surface of said donor member spaced from the fuser member and substantially devoid of the offset preventing liquid being aligned with said stripping means

3. An apparatus according to claim 2, wherein said donor member comprises a roll having a plurality of spaced grooves therein with the grooves being spaced apart from the fuser member.

4. An apparatus according to claim 3, wherein said stripping means includes a plurality of spaced fingers with each of said fingers being alined with one of the grooves in the fuser member.

5. An apparatus according to claim 4, wherein the grooves in said roll are arranged so that there is a pair of grooves in the same radial plane aligned with each of said fingers, wherein the pair of grooves extend about a portion of the circumference of said roll.

6. An apparatus according to claim 4, wherein said applying means comprises:

means for storing a supply of offset preventing liquid;

a roll in contact with the offset preventing liquid; and a blade member adapted to remove offset preventing liquid from said roll so that said roll applies a predetermined quantity of offset preventing liquid to said donor member.

7. An electrophotographic printing machine in which an offset preventing liquid is applied to a fuser member defining a nip with a pressure member through which a sheet having an image thereon passes to fuse the image to the sheet, wherein the improvement comprises:

a donor member having a portion of the surface thereof in contact with the surface of said fuser member, said donor member having another portion of the surface thereof spaced from the surface of said donor member; and means for applying the offset preventing liquid to the portion of the surface of said donor member in contact with said said fuser member with the portion spaced from said fuser member being substantially devoid of the offset preventing liquid.

8. A printing machine according to claim 7, further comprising means for stripping the sheet from said fuser member with the portion of the surface of said donor member spaced from the fuser member and substantially devoid of the offset preventing liquid being aligned with said stripping means 9. A printing machine according to claim 8, wherein said donor member comprises a roll having a plurality of spaced grooves therein with the grooves being spaced apart from the fuser member.

10. A printing machine according to claim 9, wherein said stripping means includes a plurality of spaced fingers with each of said fingers being alined with one of the grooves in the fuser member.

11. A printing machine according to claim 10, wherein the grooves in said roll are arranged so that there is a pair of grooves in the same radial plane aligned with each of said fingers, wherein the pair of grooves extend about a portion of the circumference of said roll.

12. A printing machine according to claim 10, wherein said applying means comprises:

means for storing a supply of offset preventing liquid;

a roll in contact with the offset preventing liquid; and a blade member adapted to remove offset preventing liquid from said roll so that said roll applies a predetermined quantity of offset preventing liquid to said donor member.

* * * * *